US010229660B2

(12) United States Patent
Miyajima

(10) Patent No.: US 10,229,660 B2
(45) Date of Patent: Mar. 12, 2019

(54) CAPOTASTO

(71) Applicants: GOTOH GUT CO., LTD., Isesaki-shi, Gunma (JP); Hiroshi Miyajima, Yokohama-shi, Kanagawa (JP)

(72) Inventor: Hiroshi Miyajima, Yokohama (JP)

(73) Assignees: GOTOH GUT CO., LTD, Isesaki-Shi, Gunma (JP); HIROSHI MIYAJIMA, Yokohama-Shi, Kanagawa (JP)

( * ) Notice: Subject to any disclaimer, the term of this patent is extended or adjusted under 35 U.S.C. 154(b) by 0 days.

(21) Appl. No.: 15/916,935

(22) Filed: Mar. 9, 2018

(65) Prior Publication Data

US 2018/0268789 A1 Sep. 20, 2018

(30) Foreign Application Priority Data

Mar. 16, 2017 (JP) ..... 2017-051051

(51) Int. Cl.
*G10D 3/04* (2006.01)

(52) U.S. Cl.
CPC ..... *G10D 3/043* (2013.01)

(58) Field of Classification Search
CPC ..... G10D 3/043
USPC ..... 84/318
See application file for complete search history.

(56) References Cited

U.S. PATENT DOCUMENTS 3,185,012 A * 5/1965 Dunlop ..... G10D 3/043 84/318
3,191,480 A * 6/1965 Lowe ..... G10D 1/10 84/314 N
3,504,589 A * 4/1970 Wowries ..... G10D 3/043 84/318
3,598,012 A * 8/1971 Dunlop ..... G10D 3/043 84/288
3,722,346 A * 3/1973 Valentino ..... G10D 3/043 84/318
3,823,247 A * 7/1974 Bauerfeind ..... G10D 3/043 84/318
3,933,077 A * 1/1976 Dunlop ..... G10D 3/043 84/318
4,104,947 A * 8/1978 Oster ..... G10D 3/043 84/318
4,112,805 A * 9/1978 Carter ..... G10D 3/043 84/317

(Continued)

FOREIGN PATENT DOCUMENTS

JP 3043273 U 9/1997
JP 2011-515709 A 5/2011
JP 2015-225335 A 12/2015

*Primary Examiner* — David Warren
*Assistant Examiner* — Christina Schreiber
(74) *Attorney, Agent, or Firm* — Brinks, Gilson & Lione

(57) ABSTRACT

A capotasto C includes a clamp 100 and a lever 400. The clamp 100 includes a supporting bar 200 and a string pressing bar 300. The lever 400 is engaged with the supporting bar 200 and with the string pressing bar 300. In a condition in which the clamp 100 has a neck 1 of a guitar between the supporting bar 200 and the string pressing bar 300, when the lever 400 is pushed to the neck 1, the clamp 100 is closed, and a pressing pad 332 of a string pressing part 330 of the clamp 100 presses strings 3 onto a surface 1*a* of the neck 1. When the lever 400 is pulled out, the clamp 100 is opened by a biasing force of an open spring 120 of the clamp 100, and the capotasto C can be removed from the neck 1.

5 Claims, 4 Drawing Sheets

(56) References Cited

U.S. PATENT DOCUMENTS 4,143,576 A * 3/1979 Nichols ..... G10D 3/043 84/318
4,183,279 A * 1/1980 Shabram, Jr. ..... G10D 3/043 84/318
4,412,472 A * 11/1983 Welch ..... G10D 3/043 84/318
4,475,433 A * 10/1984 Williamson ..... G10D 3/043 84/318
4,503,747 A * 3/1985 Labbe ..... G10D 3/043 84/318
4,753,147 A * 6/1988 Berardi ..... G10D 3/046 84/267
4,793,234 A * 12/1988 Geis ..... G10D 3/043 84/318
4,926,732 A * 5/1990 Collins ..... G10D 3/043 84/318
5,016,514 A * 5/1991 Kaufman ..... G10D 3/043 84/318
5,492,045 A * 2/1996 Roblee ..... G10D 3/043 84/318
5,792,969 A * 8/1998 Shubb ..... G10D 3/043 84/318
6,410,832 B1 * 6/2002 Sterner ..... G10D 3/043 84/318
6,459,025 B1 * 10/2002 D'Addario ..... G10D 3/043 84/318
7,511,208 B1 * 3/2009 Kyser ..... G10D 3/043 84/318
7,932,450 B2 * 4/2011 Chen ..... G10D 3/043 84/318
8,093,476 B2 * 1/2012 Vochezer ..... G10D 3/043 84/318
8,101,839 B1 * 1/2012 KauFman ..... G10D 3/043 84/312 R
9,035,161 B2 * 5/2015 Campling ..... G10D 3/043 84/318
9,978,347 B1 * 5/2018 Liang ..... G10D 3/043
2004/0261600 A1 * 12/2004 Silva ..... G10D 3/043 84/318
2009/0241752 A1 * 10/2009 Vochezer ..... G10D 3/043 84/318
2010/0154616 A1 * 6/2010 Campling ..... G10D 3/043 84/318
2010/0275757 A1 * 11/2010 Hallet ..... A63C 11/025 84/318
2011/0023683 A1 * 2/2011 Vochezer ..... G10D 3/043 84/318
2013/0055877 A1 * 3/2013 Duncan ..... G10D 3/043 84/318
2013/0192442 A1 * 8/2013 Ruck ..... G10D 3/043 84/318
2015/0128784 A1 * 5/2015 Bradley ..... G10D 3/043 84/318
2016/0247490 A1 * 8/2016 Campling ..... G10D 3/043
2018/0102113 A1 * 4/2018 Campling ..... G10D 3/043
2018/0268789 A1 * 9/2018 Miyajima ..... G10D 3/043

* cited by examiner

CAPOTASTO

RELATED APPLICATIONS

This application claims priority under 35 U.S.C. § 119 to Japanese Patent Application No. 2017-051051 filed on Mar. 16, 2017, the entire content of which is hereby incorporated by reference.

BACKGROUND OF THE INVENTION

1. Field of the Invention

The present invention relates to a performance support device for a stringed instrument, such as a guitar or a ukulele, and in particular, relates to a capotasto used to collectively shorten the effective lengths of all strings so as to transpose the entire instrument.

2. Description of the Related Art

Various designs and types of capotastos have been developed. Typical structures of capotastos for clamping a neck of a guitar include a clip structure for retaining a fixed condition using a spring, a structure for holding the neck from upper and lower sides in the same way as a vise, and a structure to be fixed by hooking a rubber band (refer to Japanese Examined Utility Model (Registration) Application Publication No. 3043273, Japanese Unexamined Patent Application Publication (Translation of PCT Application) No. 2011-515709, and Japanese Unexamined Patent Application Publication No. 2015-225335).

In view of various situations, for example, a situation in which a capotasto is used to perform transposition during a performance and a situation in which a capotasto is reattached to another guitar in a short time, an ideal capotasto is smoothly attachable and detachable to a neck without requiring a large amount of force. However, a conventional capotasto is removed from a neck, for example, in such a way that its lever is gripped to release the state of attachment to the neck against a force of its spring, and then it is pulled upwardly. In this way, the conventional capotasto requires a prior action different from a final action for removing it from the neck. Thus, the conventional capotasto is difficult to smoothly attach to and detach from a neck. Another conventional capotasto using a spring may require a large force to attach and detach it. Accordingly, some conventional capotastos are difficult for users with a weak grip to use.

SUMMARY OF THE INVENTION

The present invention has been completed in view of these circumstances, and an object of the present invention is to provide a capotasto that is smoothly attachable and detachable to a neck without requiring a large force with minimal operation.

The present invention provides a capotasto that can be detachably attached to a neck of a stringed instrument to press the strings of the stringed instrument onto a surface of the neck. The capotasto includes a clamp, an opening-direction urging member, and a clamp opening-and-closing member. The clamp includes a supporting bar and a string pressing bar for holding the neck therebetween. The supporting bar is configured to be arranged at a back surface side of the neck. The string pressing bar is configured to be arranged at a surface side of the neck and has a string pressing part provided at its neck facing surface. The supporting bar and the string pressing bar are openably and closeably supported via an opening and closing shaft that are mounted to one of the ends thereof. The supporting bar and the string pressing bar have an opening therebetween at the other of the ends thereof in the closed condition. The opening-direction urging member is provided to the clamp and urges in a direction to open the clamp. The clamp opening-and-closing member is arranged in a side opposite to the opening of the clamp. The clamp opening-and-closing member elastically engages with the supporting bar and with the string pressing bar and is slidable on the supporting bar and on the string pressing bar approximately along a width direction of the neck in a condition in which the clamp clamps the neck. When being slid in a direction approaching the opening and closing shaft, the clamp opening-and-closing member closes the clamp against an urging force of the opening-direction urging member and enables clamping of the neck and allowing the string pressing part to continue pressing the surface of the neck. When being slid in a direction away from the opening and closing shaft, the clamp opening-and-closing member allows the clamp to open by the urging force of the opening-direction urging member.

In the capotasto of the present invention, the clamp opening-and-closing member may be pushed into, and be slid, in the direction approaching the opening and closing shaft, that is, to the neck, from a condition in which the neck of the stringed instrument is inserted into the clamp. In this case, the clamp closes and strongly clamps the neck, whereby the capotasto is attached to the neck. At this time, the string pressing part presses the surface of the neck, and the strings are pressed onto the surface of the neck, whereby transposition is performed. On the other hand, when the clamp opening-and-closing member is pulled and is slid in the direction away from the opening and closing shaft, that is, in a direction away from the neck from the attached condition, the clamp opens. By further pulling the clamp opening-and-closing member, the capotasto is detached from the neck.

As described above, the attachment and removal relative to the neck are respectively performed with one action by pressing and pulling the clamp opening-and-closing member approximately along the width direction of the neck. Thus, the capotasto is smoothly attached to and is detached from the neck with minimal operation. The clamp opening-and-closing member is slid by using the entire arm of a player. This enables use of a large force, thereby facilitating the movements of attaching and detaching.

The clamp opening-and-closing member of the present invention may be constituted primarily of a plate spring. The plate spring extends in an approximately U-shape along an outside surface that extends from the supporting bar to the string pressing bar via the opening and closing shaft and is provided around the outside surface. The plate spring has an end part that slidably engages with the supporting bar and has the other end that slidably engages with the string pressing bar. In this case, the clamp opening-and-closing member constituted primarily of the U-shaped plate spring enables easy handling of the capotasto. Moreover, in particular, this structure enables easy removal of the capotasto from the neck because the capotasto is pulled by hooking a finger or another tool at the clamp opening-and-closing member.

The string pressing part of the present invention may have an elastic body configured to directly contact the surface of the neck. The elastic body is swingably supported by the string pressing bar via a swinging shaft that is configured to be approximately parallel to an extending direction of the neck. This structure enables the elastic body to reliably press all strings onto the surface of the neck with a uniform force, thereby providing good musical sound.

The string pressing bar or the supporting bar of the present invention may be provided with a positioning part configured to be fitted to an edge part of the neck to position the clamp relative to the neck. This structure enables stabilizing the attitude of the capotasto in attaching the capotasto to the neck, thereby facilitating control of the clamp opening-and-closing member.

In the present invention, in order not to damage the neck, the clamp preferably has a cushion provided at its part to contact the neck.

The capotasto of the present invention enables smooth attachment and detachment relative to a neck without requiring a large force with minimal operation.

BRIEF DESCRIPTION OF THE DRAWINGS

FIG. 1A is a rear view, and FIG. 1B is a side view.

FIG. 2A is a side view, and FIG. 2B is a front view.

FIG. 4A is a rear view, FIG. 4B is a side view, and FIG. 4C is a front view.

DETAILED DESCRIPTION OF THE PREFERRED EMBODIMENTS

Hereinafter, an embodiment employing the present invention in a capotasto for a guitar will be described with reference to the drawings.

(1) Structure of Capotasto

Figure 1A:
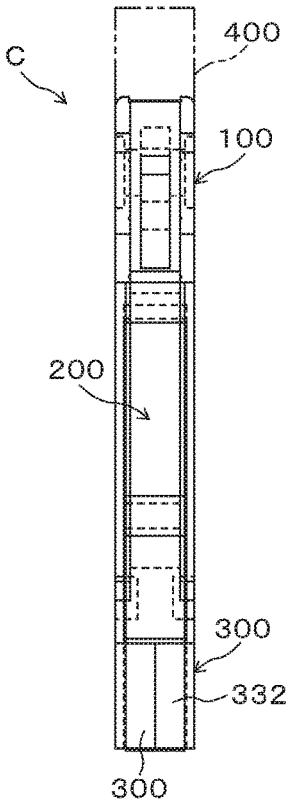
FIGS. 1A and 1B illustrate a capotasto according to an embodiment of the present invention.
Figure 1B:
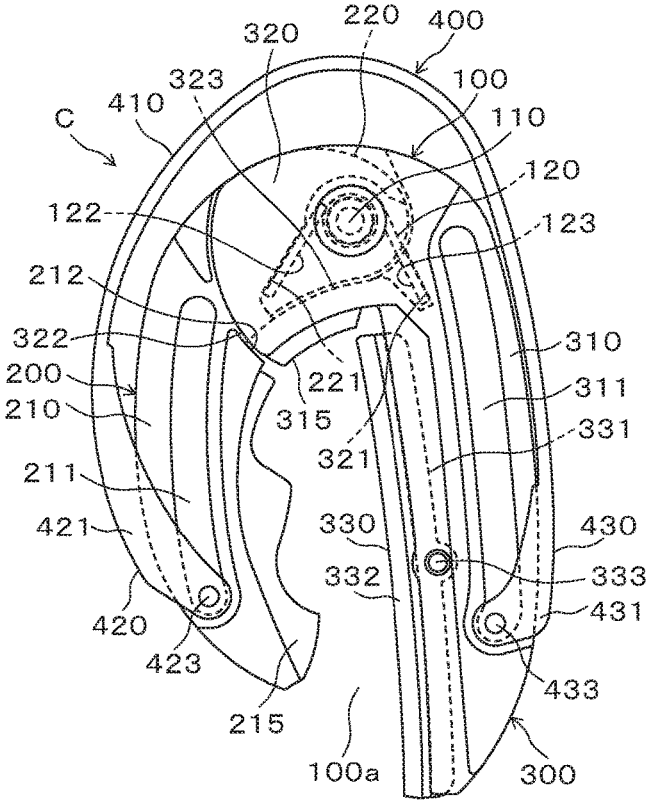
Figure 2A:
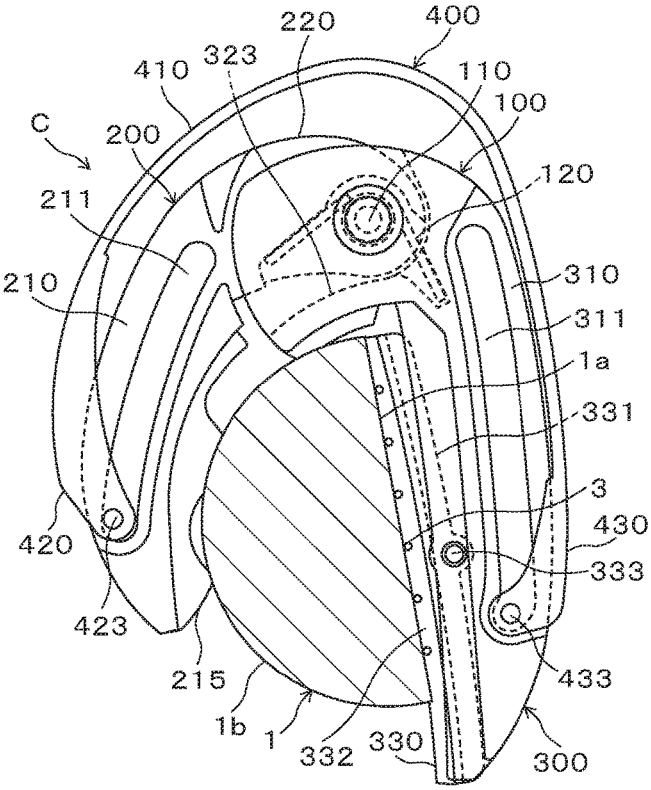
FIGS. 2A and 2B illustrate the capotasto in an attached state to a neck of a guitar.
Figure 2B:
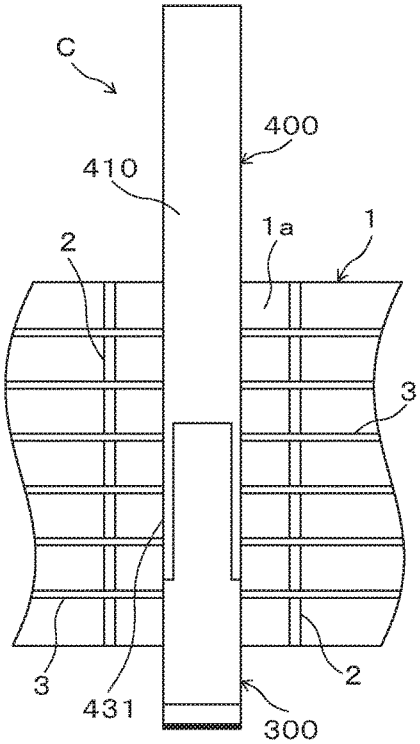
Figure 3:
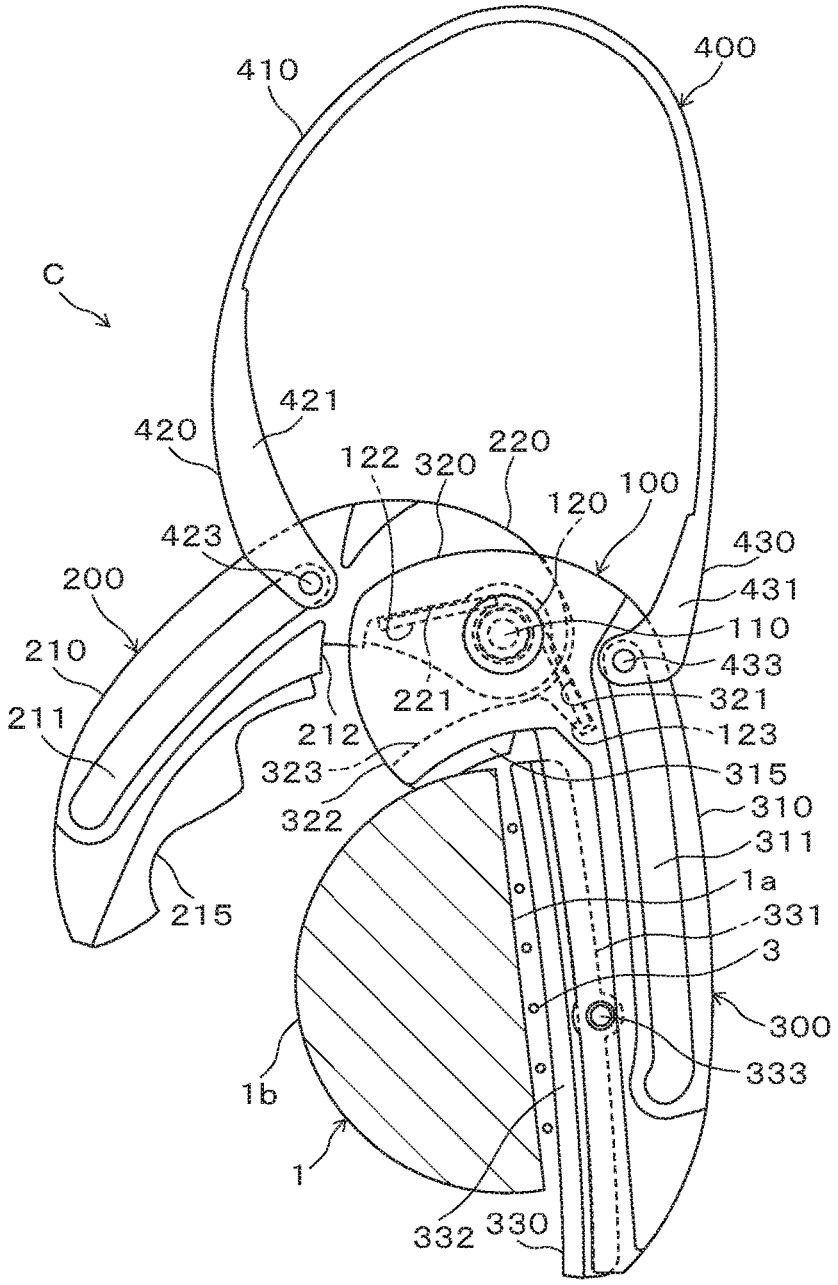
FIG. 3 is a side view illustrating the capotasto in a removed state from a neck of a guitar or in a state prior to being attached to a neck of a guitar.

FIGS. 1A and 1B illustrate a capotasto C according to an embodiment. FIGS. 2A and 2B illustrate the capotasto C in an attached state between frets 2 of a neck 1. FIG. 3 illustrates the capotasto C in a state removed from the neck 1 or in a state prior to being attached to the neck 1. The capotasto C of this embodiment is detachably attached to the neck 1 from above in a condition in which a player holds the guitar at a position for performance, that is, in a condition in which a player holds the neck 1 in an approximately horizontal direction.

As illustrated in FIGS. 1A to 3, the capotasto C includes a clamp 100 and a lever (clamp opening-and-closing member) 400. The clamp 100 is constituted by joining a supporting bar 200 and a string pressing bar 300 openably and closeably. The lever 400 is annular and is used for opening and closing the clamp 100. When the lever 400 is upwardly pulled out from the clamp 100 as illustrated in FIG. 3 from the condition illustrated in FIGS. 1A and 1B, the clamp 100 opens and is in an attachable state to the neck 1 of the guitar.

FIGS. 1A and 1B illustrates the capotasto C in a condition in which the capotasto C is removed from the neck 1 and the lever 400 is pushed into the clamp 100 to be received. The capotasto C may be stored and be carried in this received condition. The clamp 100 in the received condition slightly opens but does not further close, and this slightly opened condition is the most closed condition. In the following descriptions, unless otherwise noted, upper and lower directions or vertical direction and right and left directions or lateral direction are defined relative to the clamp 100 in the state attached to the neck 1, and an inside is defined as the neck 1 side relative to the clamp 100 in the state attached to the neck 1.

The supporting bar 200 constituting the clamp 100 is formed into a shape having a main part 210 and an upper end part 220. The main part 210 curvedly extends in the vertical direction so as to be approximately along a back surface 1*b* of the neck 1. The upper end part 220 has a curved shape that is inwardly curved into an obtuse angle from an upper end of the main part 210. The inside surface of the main part 210 that is configured to face the back surface 1*b* of the neck 1 has a cushion 215 adhered thereon. The cushion 215 is made of an elastic body such as rubber or synthetic resin, of each type. Although the cushion 215 has an uneven surface with two steps along from upward to downward in this embodiment, the surface may have any shape.

The string pressing bar 300 constituting the clamp 100 is formed into a shape having a main part 310 and an upper end part 320. The main part 310 extends along the vertical direction. The upper end part 320 has a curved shape that is inwardly curved into an acute angle from an upper end of the main part 310. The main part 310 is configured to face the surface 1*a* of the neck 1 and has a length sufficient to cover the entirety in the width direction of the neck 1. The main part 310 has a string pressing part 330 provided to its inside surface that is a facing surface to the neck 1.

The string pressing part 330 is configured of a receiving plate 331 and a pressing pad (elastic body) 332 that is adhered on the inside surface of the receiving plate 331. The receiving plate 331 extends along the main part 310. The pressing pad 332 is made of an elastic body such as rubber or synthetic resin, of each type. The receiving plate 331 is slightly curved so as to be along the neck 1, and the pressing pad 332 is also curved in a similar manner as in the receiving plate 331. The pressing pad 332 is pressed against the surface 1*a* of the neck 1 to press all of strings 3 above the neck 1 onto the surface 1*a* of the neck 1. The pressing pad 332 has a cross sectional shape formed into, for example, a triangle or a baseball home base shape, so as to have an acute angle at its tip edge that is to be contacted to the strings 3. The receiving plate 331 is swingably supported at its center in the longitudinal direction by the string pressing bar 300 via a swinging shaft 333 that extends laterally. Thus, the pressing pad 332 is swingable via the swinging shaft 333 that is approximately parallel in the lateral direction, that is, the extending direction of the neck 1 in the condition in which the capotasto C is attached to the neck 1.

The upper end part 320 of the string pressing bar 300 is configured to face an upper edge part of the neck 1 and has a cushion (positioning part) 315 adhered on its inside. The cushion 315 is made of the same material as the cushion 215. The surface of the cushion 315 of the string pressing bar 300 is formed into a curved surface so as to be approximately along the upper edge part of the neck 1. The inside surface of the upper end part 320 is formed into a curved surface that continues to the inside surface of the main part 210 of the supporting bar 200 in the received condition illustrated in FIG. 1B. The main part 210 of the supporting bar 200 includes a stopper wall 212 formed at its inside surface upper end. The stopper wall 212 is configured to be brought into contact with an end surface lower part 322 of the upper end part 320 of the string pressing bar 300 to regulate an open angle of the clamp 100 in the received condition.

The upper end part 320 of the string pressing bar 300 is formed with a groove 323 that opens upwardly. The upper end part 220 of the supporting bar 200 is fitted into the groove 323, whereby the upper end parts 220 and 320 are rotatably overlapped. In this overlapped condition, the upper end parts 220 and 320 are rotatably connected to each other by an opening and closing shaft 110 that extends laterally. Thus, the clamp 100 is openably and closeably supported via the opening and closing shaft 110 and has an opening 100*a* at its other end side (lower end side) so as to be open as illustrated in FIG. 1B. An opening spring (opening-direction urging member) 120 is fitted to the opening and closing shaft 110 and urges the clamp 100 in an opening direction. The opening spring 120 is a torsion coil spring fitted in a compressed condition and has arms 122 and 123 at its respective ends. The arm 122 is elastically engaged with an inner wall 221 formed in the upper end part of the supporting bar 200, whereas the arm 123 is elastically engaged with an inner wall 321 formed in the upper end part 320 of the string pressing bar 300.

The supporting bar 200 has a guide groove 211 at each side surface in the lateral direction of the main part 210. The guide grooves 211 extend in a slightly curved form along the main part 210. Also, the string pressing bar 300 has a guide groove 311 at each side surface in the lateral direction of the main part 310. The guide grooves 311 extend in a slightly curved form along the main part 310.

The lever 400 includes an elastic part 410 as a main body, and the elastic part 410 is formed of a plate spring obtained by bending a stripped plate spring material. The lever 400 is arranged in an upper side that is opposite to the opening 100*a* side. As illustrated in FIG. 1B, the elastic part 410 of the lever 400 is formed into a shape extending in an approximately U-shape (reversed U-shape in FIGS. 1A to 3) along an outside surface that extends from the supporting bar 200 to the string pressing bar 300 via the opening and closing shaft 110, and it is arranged around this outside surface.

Figure 4A:
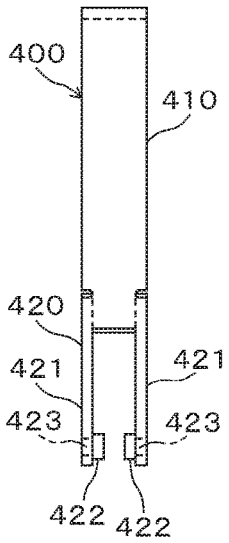
FIGS. 4A to 4C illustrate a lever provided to the capotasto.
Figure 4B:
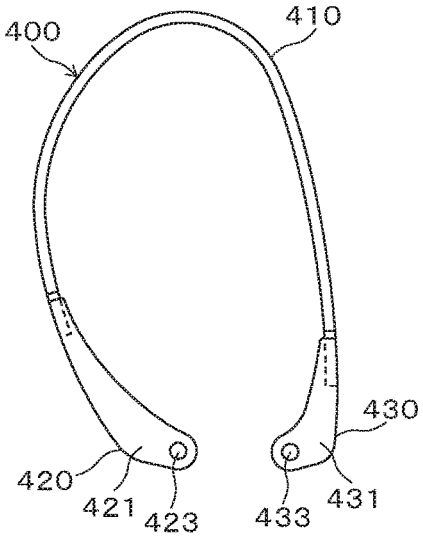
Figure 4C:
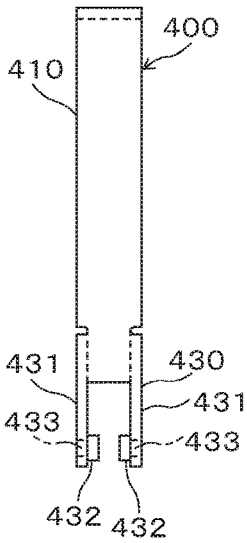

As illustrated in FIGS. 4A to 4C, the elastic part 410 is provided with an engaging part 420 for engaging with the supporting bar 200, at an end, and is also provided with an engaging part 430 for engaging with the string pressing bar 300, at the other end. The engaging part 420 for engaging with the supporting bar 200 has engaging pieces 421 that form a fork shape. The engaging pieces 421 forming a fork shape have a pair of rollers 422 that are respectively rotatably supported at inner sides of their lower end parts via rotational shafts 423 extending in the lateral direction. The engaging part 420 engages with the supporting bar 200 such that the engaging pieces 421 forming a fork shape pinch the supporting bar 200 and that the rollers 422 at both sides are respectively rollably fitted into the guide grooves 211 at both sides of the supporting bar 200.

Similarly to this structure, the engaging part 430 for engaging with the string pressing bar 300 also has engaging pieces 431 that form a fork shape. The engaging pieces 431 have a pair of rollers 432 that are respectively rotatably supported at inner sides of their lower end parts via rotational shafts 433 extending in the lateral direction. The engaging part 430 engages with the string pressing bar 300 such that the engaging pieces 431 forming a fork shape pinch the string pressing bar 300 and that the rollers 432 at both sides are respectively rollably fitted into the guide grooves 311 at both sides of the string pressing bar 300.

The engaging parts 420 and 430 may be made separately from the elastic part 410, and these engaging parts 420 and 430 may be provided by being fixed at ends of the elastic part 410 by welding or another method. Alternatively, the engaging parts 420 and 430 may be provided to the elastic part 410 in an integral manner.

The engaging part 420 is engaged so as to be slidable in the width direction, that is, the vertical direction of the neck 1 along the guide grooves 211 of the supporting bar 200 via the rollers 422. Also, the engaging part 430 is engaged so as to be slidable in the width direction, that is, the vertical direction of the neck 1 along the guide grooves 311 of the string pressing bar 300 via the rollers 432. Thus, the lever 400 can be upwardly pulled out from, and be downwardly pushed into, relative to the clamp 100, as described above.

The guide grooves 211 and 311 are arranged side by side and extend in the vertical direction, and they are approximately parallel to each other so as to have a maximum space therebetween in the vicinity of their intermediate points in the longitudinal direction, as viewed from a side of the clamp 100 in the received condition as illustrated in FIG. 1B. Thus, the lever 400 opens at the greatest degree when the rollers 422 and 432 pass through the intermediate points.

(2) Movement of Capotasto

Hereinafter, movement of the capotasto C that is not attached to the neck 1 will be described.

(2-1) Received Condition

As illustrated in FIG. 1B, the capotasto C is in the received condition when the lever 400 is pushed into the clamp 100 until the rollers 422 and 432 (not shown in FIG. 1B), which are supported at the lower end parts of the lever 400 by the rotational shafts 423 and 433, respectively reach the lower end parts of the guide grooves 211 and 311. In this received condition, the elastic part 410 of the lever 400 opens wider than its open degree in a no-load condition as illustrated in FIG. 4B, and therefore, an elastic force is generated in the lever 400 so that the engaging parts 420 and 430 come close to each other in a closing direction. The resilient force of the lever 400 due to the elastic force is greater than the urging force of the opening spring 120 that urges the clamp 100 in the opening direction. Although the clamp 100 is closed by the elasticity of the lever 400, since the stopper wall 212 of the supporting bar 200 contacts the end surface lower part 322 of the upper end part 320 of the string pressing bar 300, the clamp 100 is regulated so as to have an open angle in the received condition.

(2-2) Movement for Opening Clamp

When the lever 400 is pulled upwardly from the clamp 100 in the received condition illustrated in FIG. 1B, the rollers 422 and 432 respectively roll along the guide grooves 211 and 311, whereby the lever 400 is opened. As the lever 400 opens, the resilient force of the elastic part 410 gradually increases accordingly. Then, the rollers 422 and 432 respectively pass through the points in the vicinity of the intermediate points of the guide grooves 211 and 311, at which the resilient force is the greatest due to the maximally opened lever 400. Thereafter, the lever 400 is urged by the resilient force for closing the lever 400 and immediately slides upwardly along the guide grooves 211 and 311 until the rollers 422 and 432 respectively reach the upper end parts of the guide grooves 211 and 311.

Meanwhile, in accordance with this movement, the restriction by the elasticity of the lever 400 is released, and the clamp 100 is opened by the urging force of the opening spring 120 (refer to FIG. 3). The open angle of the clamp 100 is regulated by the engagement of the lever 400 with the supporting bar 200 and with the string pressing bar 300 so as to have a space between the supporting bar 200 and the string pressing bar 300 that allows entering of the neck 1.

(2-3) Movement for Closing Clamp

While the lever 400 is pushed to the clamp 100 in the opened condition as illustrated in FIG. 3 against the urging force of the opening spring 120, the rollers 422 and 432 respectively roll along the guide grooves 211 and 311. Thus, the lever 400 is open, whereby the resilient force of the elastic part 410 is increased, and the clamp 100 is fastened and is closed by the lever 400. Then, the rollers 422 and 432 respectively pass through the points at which the resilient force is the greatest due to the maximally opened lever 400 in the vicinity of the intermediate points of the guide grooves 211 and 311. Thereafter, the lever 400 is urged by the resilient force for closing the lever 400 and immediately slides downwardly along the guide grooves 211 and 311 until the rollers 422 and 432 respectively reach the lower end parts of the guide grooves 211 and 311. Thus, the capotasto C returns to the received condition as illustrated in FIG. 1B.

(3) Movement for Attaching or Detaching Capotasto Relative to Neck

Next, movement for attaching the capotasto C to the neck 1 of the guitar will be described, followed by description of movement for removing the capotasto C from the neck 1 of the guitar.

(3-1) Attachment to Neck

To attach the capotasto C to the neck 1, the lever 400 is pulled out from the clamp 100 to open the clamp 100, as illustrated in FIG. 3. In a condition in which the supporting bar 200 is arranged at a player side (left side in FIG. 3) whereas the string pressing bar 300 is arranged at a front side of the player (right side in FIG. 3), this clamp 100 is downwardly fitted to the neck 1 between the frets 2 of the neck 1 as illustrated in FIG. 2B. The clamp 100 has the supporting bar 200 arranged at the back surface 1*b* side of the neck 1 and has the string pressing bar 300 arranged at the surface 1*a* side of the neck 1, thereby clamping the neck 1.

Next, the capotasto C is positioned by fitting the cushion 315 to the upper edge part of the neck 1 while holding the lever 400. In this condition, the above-described "Movement for Closing Clamp" is performed. That is, the lever 400 is downwardly pressed to the neck 1. The lever 400 that is downwardly pressed strongly fastens the clamp 100, and the clamp 100 strongly clamps the neck 1, whereby the capotasto C is attached to the neck 1 as illustrated in FIGS. 2A and 2B. In this attached condition, the pressing pad 332 of the string pressing part 330 is pressed against the surface 1*a* of the neck 1, causing all of the strings 3 to be pressed onto the surface 1*a* of the neck 1. As a result, transposition is performed.

(3-2) Removal of Capotasto from Neck

To remove the capotasto C from the neck 1, the lever 400 is gripped to perform the above-described "Movement for Opening Clamp". That is, the lever 400 is pulled upwardly in a direction away from the neck 1. When the lever 400 is pulled out, the clamp 100 opens and releases the neck 1. When the lever 400 is further pulled out, the capotasto C is detached from the neck 1.

(4) Effects of Embodiment

The capotasto C of this embodiment is attached to or is removed from the neck 1 by one action of straightly pushing or pulling the lever 400 along the vertical direction (width direction of the neck 1). Thus, the capotasto C is smoothly attached to, and is detached from, the neck 1 with minimal operation. Moreover, the lever 400 is slid on the clamp 100 by using the entire arm of a player. This enables use of a large force, thereby facilitating the movements of attaching and detaching.

The lever 400 having the U-shape is easy to hold and grip. In particular, in a case of pulling out the lever 400 to remove the capotasto C from the neck 1, the lever 400 is easily pulled out by hooking it with a finger. Accordingly, the lever 400 has superior operability. Grasping the lever 400 enables easy handling of the capotasto C in a case of carrying the capotasto C or in other cases. The space of some degree between the lever 400 and the clamp 100 generated in the received condition enables storing of the capotasto C by hooking the lever 400 on a hook or in another manner.

In the condition in which the capotasto C is attached to the neck 1, the capotasto C has an egg-shaped outline surrounding the neck 1 and has a compact form as seen from the side direction, and it has no projection. Thus, the capotasto C tends to not disturb a player and has a preferable appearance. The capotasto C is compact and thus tends to not be unintentionally touched by the hand or the arm of a player, whereby tune changes due to impact of the hand or the arm is avoided. The capotasto C in the received condition is also compact and has superior storability.

The pressing pad 332 of the string pressing part 330 is swingably supported by the string pressing bar 300 via the swinging shaft 333. Thus, the pressing pad 332 reliably presses all of the strings 3 onto the surface 1*a* of the neck 1 with uniform pressing force, thereby enabling generation of good musical sound.

As illustrated in FIG. 3, in attaching the capotasto C to the neck 1, the cushion 315 of the string pressing bar 300 is fitted to the upper edge part of the neck 1 and is depressed to position the clamp 100 relative to the neck 1. Thus, the attitude of the capotasto C is stabilized while the capotasto C is being attached, thereby facilitating control of the lever 400.

Although the supporting bar 200 and the string pressing bar 300 of this embodiment are made of a rigid material such as resin, metal, or wood, the cushions 215 and 315 directly contact the neck 1, thereby preventing damage to the neck 1.

The capotasto C described in this embodiment is for a guitar. Examples of the guitar include an acoustic guitar, an electric guitar, an electric-acoustic guitar, and a bass guitar. The capotasto C may be used for any type of guitar. The capotasto of the present invention also includes those that are modified so as to be used for a stringed instrument other than the guitar, such as a ukulele, a banjo, and a mandolin.

The present invention is preferably embodied as a capotasto that transposes a stringed instrument, such as a guitar or a ukulele.

What is claimed is:

1. A capotasto to be detachably attached to a neck of a stringed instrument to press strings of the stringed instrument onto a surface of the neck, the capotasto comprising:

a clamp including a supporting bar and a string pressing bar for holding the neck therebetween, the supporting bar configured to be arranged at a back surface side of the neck, the string pressing bar configured to be arranged at a surface side of the neck and having a string pressing part provided at its neck facing surface, the supporting bar and the string pressing bar being openably and closeably supported via an opening and closing shaft that are mounted to one of the ends thereof, the supporting bar and the string pressing bar having an opening therebetween at the other of the ends thereof in a closed condition;

an opening-direction urging member provided to the clamp and urging in a direction to open the clamp; and a clamp opening-and-closing member arranged in a side opposite to the opening of the clamp, the clamp opening-and-closing member elastically engaging with the supporting bar and with the string pressing bar and being slidable on the supporting bar and on the string pressing bar approximately along a width direction of the neck in a condition in which the clamp clamps the neck, wherein when being slid in a direction approaching the opening and closing shaft, the clamp opening-and-closing member closes the clamp against an urging force of the opening-direction urging member and enables clamping of the neck and allowing the string pressing part to continue pressing the surface of the neck, and when being slid in a direction away from the opening and closing shaft, the clamp opening-and-closing member allows the clamp to open by the urging force of the opening-direction urging member.

2. The capotasto according to claim 1, wherein the clamp opening-and-closing member is constituted primarily of a plate spring, the plate spring extends in an approximately U shape along an outside surface that extends from the supporting bar to the string pressing bar via the opening and closing shaft and is provided around the outside surface, the plate spring has an end part that slidably engages with the supporting bar and has the other end that slidably engages with the string pressing bar.

3. The capotasto according to claim 1, wherein the string pressing part has an elastic body configured to directly contact the surface of the neck, the elastic body is swingably supported by the string pressing bar via a swinging shaft that is configured to be approximately parallel to an extending direction of the neck.

4. The capotasto according to claim 1, wherein the string pressing bar or the supporting bar is provided with a positioning part configured to be fitted to an edge part of the neck to position the clamp relative to the neck.

5. The capotasto according to claim 1, further comprising a cushion being in contact with the neck.

* * * * *